US005746018A

United States Patent [19]

Kirschner et al.

[11] Patent Number: 5,746,018

[45] Date of Patent: May 5, 1998

[54] MUZZLE BRAKE FOR AN UNDERWATER GUN

[75] Inventors: Ivan N. Kirschner, Portsmouth; Gary R. Berlam, Warwick, both of R.I.

[73] Assignee: The United States of America as represented by the Secretary of the Navy, Washington, D.C.

[21] Appl. No.: 882,001

[22] Filed: May 19, 1997

[51] Int. Cl.[6] ..... F41A 21/30

[52] U.S. Cl. ..... 42/1.14; 89/14.4

[58] Field of Search ..... 42/1.14, 79; 89/14.4; 181/223, 280

[56] References Cited

U.S. PATENT DOCUMENTS

| | | | |
|---|---|---|---|
| 1,525,846 | 2/1925 | Wurtzebach | 181/223 |
| 3,300,888 | 1/1967 | Belcher et al. | 42/1.14 |
| 3,677,132 | 7/1972 | Plenge | 42/1.14 |
| 4,939,977 | 7/1990 | Stroup | 89/14.4 |
| 5,648,631 | 7/1997 | Kirschner et al. | 89/1.14 |
| 5,687,501 | 11/1997 | Stace et al. | 42/1.14 |

FOREIGN PATENT DOCUMENTS

| | | | |
|---|---|---|---|
| 72592 | 2/1983 | European Pat. Off. | 89/14.4 |

*Primary Examiner*—Stephen M. Johnson

*Attorney, Agent, or Firm*—Michael J. McGowan; Prithvi C. Lall; James M. Kasischke

[57] ABSTRACT

A device for use as a muzzle brake for an underwater gun having a projectile conveying structure with concentric inner and outer cylinders. The inner cylinder has at least one longitudinal slot formed therein. A sealing means joins the projectile conveying structure to the underwater gun at the structure's first end. A second end of the structure is provided with a seal for closing the second end after a projectile is fired through it. A piston having an aperture therethrough is positioned inside the inner cylinder and is axially moveable therein adjacent the longitudinal slot. An actuator is positioned between the inner cylinder and the outer cylinder. Actuator links through the longitudinal slot connect the piston with the actuator. After a projectile is fired through the projectile conveying structure to displace the piston from its initial position, the actuator means returns the piston to that initial position to ready the device for reuse.

13 Claims, 1 Drawing Sheet

MUZZLE BRAKE FOR AN UNDERWATER GUN

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to firearms and more particularly to firearms adapted for underwater use.

(2) Brief Description of the Prior Art

Various devices have been suggested for using firearms underwater or in the vicinity of water and for providing for use of gases to cook the firearm or clear the barrel.

U.S. Pat. No. 2,923,286 to Draganti, for example, discloses a sub-aquatic gun fired by compressed gas that is prevented from escaping the gun barrel. Compressed gas acts on a piston to push the projectile out of the barrel. The piston is braked by dashpot action and traps the gas inside the barrel for later re-use.

U.S. Pat. No. 3,476,048 to Barr et al. discloses the underwater ammunition and a weapon for firing it. When the projectile is fired, a sabot is caught at the opening of the bore thus trapping the firing gases inside the bore.

U.S. Pat. No. 3,677,132 to Plenge discloses a device which attaches to the end of a gun to keep the gun barrel waterproof and prevent the escape of expanding gases. The device includes plugs through which the bullet passes and a spring for biasing plugs in a preferred at-rest position.

U.S. Pat. No. 4,197,784 to Williams discloses a weapon which cocks itself by utilizing firing gases to move a piston. The piston is returned to an at-rest position by a spring.

U.S. Pat. No. 4,433,611 to Baumann discloses a weapon in which a breechblock piston is actuated by firing gases and returned to an at-rest position by a spring.

In particular, underwater guns have been developed which fire super-cavitating bullets underwater. To improve the ballistic performance of such a bullet, the cavitation envelope surrounding the bullet must be preserved. An important force affecting the cavitation envelope is the force caused by the combustion gas released on firing the bullet. Muzzle brakes have been developed to allow the bullet to exit the muzzle of the underwater gun before exhaust gases can affect the cavitation envelope around the bullet. One device designed to accomplish this is the prior art device shown in FIG. 1. The muzzle brake 10 is sealed to the barrel of an underwater gun (not shown), at a barrel seal 12. Barrel seal 12 joins muzzle brake body 14. Muzzle brake body 14 is filled with gas before firing. Located within muzzle brake body 14 is at least one gas capture piston 16. Gas capture piston 16 can freely slide within body 14 from a first position shown at 16 to a second position as shown at 18. The gas capture piston 16 has an aperture 20 formed at the longitudinal axis thereof. Aperture 20 is in longitudinal alignment with the underwater gun barrel and barrel seal 12. A sealing device or seal 24 is positioned on the muzzle end of body 14 to prevent water from entering the muzzle brake body 14 before firing.

In operation, a super-cavitating bullet is fired from the underwater gun through barrel seal 12. The bullet passes unimpeded through aperture 20 in gas capture piston 16.

Gases escaping from underwater gun barrel are slowed by the restricted flow area caused by aperture 20 in piston 16. Some of the pressure change from the exhaust gas is absorbed by the action of piston sliding within body 14. In the embodiment shown, the bullet proceeds to pass through seal 24. The bullet passes into the open fluid environment before exhaust gases can significantly affect the bullet's cavitation envelope.

One problem with the operation of such prior art devices is that they require that the gas capture piston be manually reset after each firing of the gun. The gun's effectiveness is therefore greatly limited without a multiple shot capability.

SUMMARY OF THE INVENTION

A first object of the present invention is to prevent launch gases from interfering with the flight of an underwater bullet.

Another object of this invention is to provide an underwater gun with a multiple shot capability.

Yet another object is that such a device provide variable resistance to egress of launch gases.

Accordingly, the present invention provides a gas containing, projectile conveying, structure having opposed first and second ends. The structure has at its first end a muzzle seal sealing the structure to a barrel of the underwater gun. At its second end, the structure has a projectile exit and a means for sealing the projectile exit. At least one piston is positioned inside the projectile conveying structure and is capable of axial motion therein between an initial position which is nearer the first end of the structure and a second position which is nearer the second end of the conveying structure. The piston has an axial aperture therethrough which allows passage of a projectile from the first end to the second end of the projectile conveying structure. The piston is joined to an actuator through slots in the conveying structure. When a projectile is fired, the piston contains much of the resulting gas while the projectile passes through the axial aperture in the piston. The gas, however, causes displacement of the piston from its initial position to the second position. After firing, the actuator returns the piston from the second position to the initial position to prepare the device for firing another projectile.

BRIEF DESCRIPTION OF THE DRAWINGS

The present invention will be more fully understood when the following description is read in light of the accompanying drawings in which.

DETAILED DESCRIPTION OF THE PREFERRED EMBODIMENT

Figure 1:
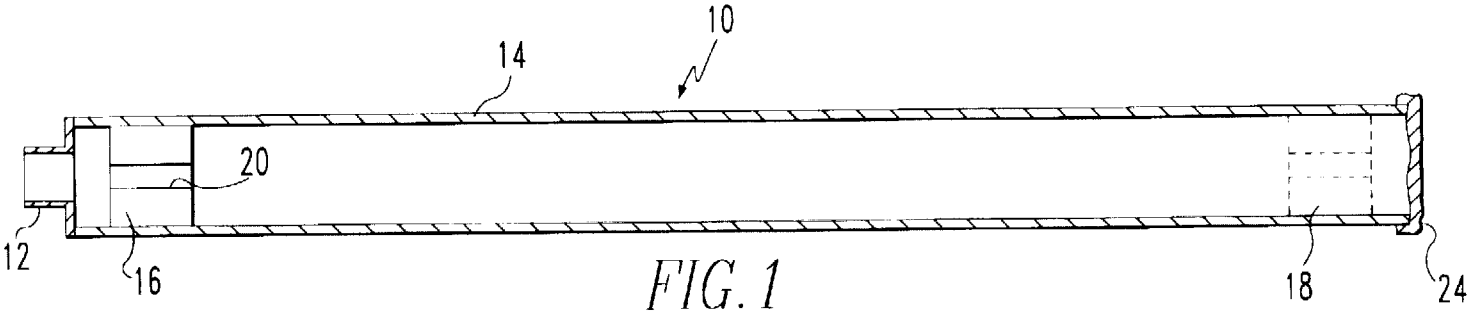
FIG. 1 PRIOR ART
FIG. 1 is a vertical cross sectional view of a prior art muzzle brake for an underwater gun.
Figure 2:
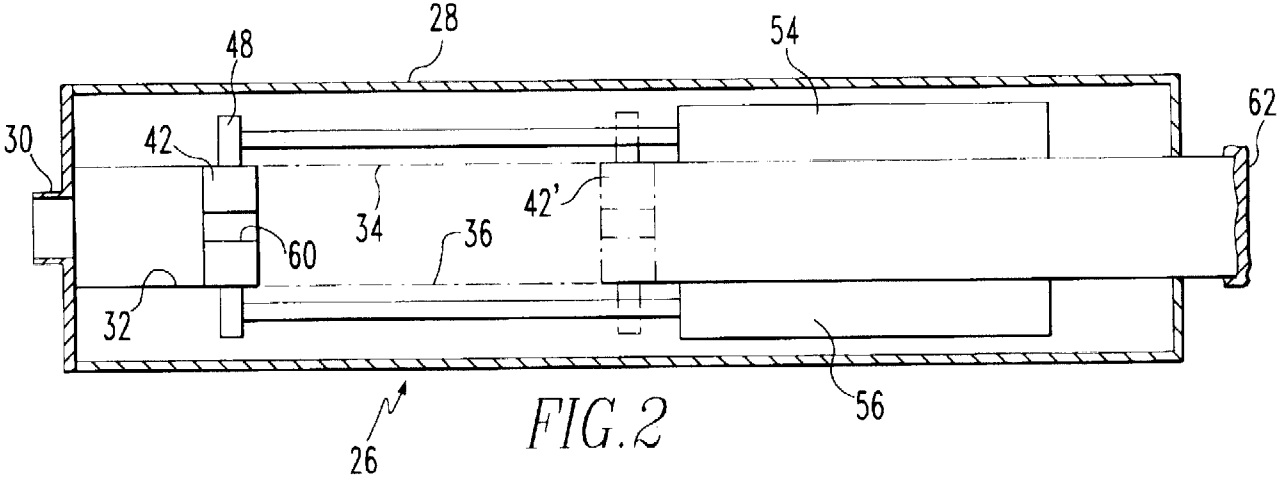
FIG. 2 is a vertical cross sectional view of a preferred embodiment of the muzzle brake for an underwater gun of the present invention.

The current invention as shown in FIG. 2 provides a method for providing gas capture pistons in a multiple shot underwater gun. A muzzle brake 26 has an outer cylindrical shell portion 28, a barrel seal 30 and an inner cylindrical shell 32. Inner shell 32 has actuator arm slots 34 and 36 formed therein. A gas capture piston 42 is positioned in a first position near barrel seal 30 where the muzzle brake 26 is fixed to the barrel of an underwater gun (not shown). A second position of the piston is shown at 42'. Gas capture piston 42 is joined by actuator link 48 to actuators 54 and 56.

These actuators are positioned between outer cylindrical shell portion 28 and inner cylindrical shell 32. Gas capture piston 42 has an aperture 60 formed longitudinally through piston 42. Actuators 54 and 56 are preferably hydraulic or pneumatic actuators which can provide a dashpot action, but electrical actuators can alternately be used. The muzzle brake 26 is provided with a seal 62. Seal 62 must be a device that reseals the barrel after penetration by the bullet. Seal 62 can be any sealing device such as those disclosed in U.S. patent application Ser. Nos. 08/540,419 and 08/613,814 filed respectively on Oct. 3, 1995 and Mar. 6, 1996. A single gas capture piston can be provided within the underwater gun barrel, or the number of pistons can be selected to optimize the system.

In operation, a super-cavitating bullet is fired from the underwater gun thorough barrel seal 24. The bullet passes unimpeded through aperture 60 in gas capture piston 42. Gases escaping from an underwater gun barrel are slowed by the restricted flow area caused by aperture 60 in piston 42. Some of the pressure change from the exhaust gases is absorbed by the movement of piston 42. Movement of piston 42 to second position 42' is restrained by actuators 54 and 56. The bullet passes through seal 62 into the open fluid environment before exhaust gases can significantly affect the bullet's cavitation envelope. Actuators 54 and 56 allow greater control over the resistance provided by piston 42. To reset the muzzle brake 26 for firing another round, actuators 54 and 56 are activated to move piston 42 back to its original position.

It will be appreciated that the muzzle brake of this invention provides for multiple round firing from an underwater gun. It also provided a method of gas suppression control within a muzzle suppression device.

Those skilled in the art will also appreciate that different numbers of gas capture pistons can be used, and that the initial positioning of the pistons can be modified. The actuators can be used to provide different positions for the pistons to give differing suppression characteristics. For example, a low noise ejection profile or a high velocity ejection profile can be provided.

The pistons as provided could be the core of a solenoid with the coil of the solenoid positioned in the intermediate region between inner and outer shells. Activation of the solenoid coil could act to reposition pistons, and back current generated on movement of the pistons could provide resistance. Accordingly, the piston can be moved without the provision of slots 34 and 36.

It will also be understood that by the term "underwater gun" as used herein what is meant is any firearm adapted for underwater use regardless of the muzzle characteristics or the ammunition used.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A muzzle brake for an underwater gun comprising:

a gas containing projectile conveying structure having opposed first and second ends;

a sealing means positioned at said structure first end for sealing said structure to the barrel of the underwater gun;

a penetrable seal device positioned at said structure second end providing a projectile exit means;

at least one piston positioned inside the projectile conveying structure and capable of axial motion therein between an initial position and a second position and having an axial aperture therethrough, said piston being displaced from said initial position to said second position by gases form said underwater gun; and means for returning said at least one piston from the second position to the initial position after said piston has been displaced to said second position.

2. The muzzle brake of claim 1 wherein the projectile conveying structure is cylindrical.

3. The muzzle brake of claim 2 wherein:

said the projectile conveying structure is comprised of an outer cylinder and a concentric inner cylinder;

said the piston is positioned inside the inner cylinder and moves axially inside the inner cylinder; and said means for returning the piston from its second position to its first position is positioned between the outer and inner concentric cylinders.

4. The muzzle brake of claim 3 wherein the means for returning the piston from its second position to its first position is a hydraulic actuator.

5. The muzzle brake of claim 3 wherein the piston and cylinder combination is a pneumatic actuator.

6. The muzzle brake of claim 4 wherein there are a pair of opposed hydraulic actuators positioned in opposed positions between the inner and outer cylinders.

7. The muzzle brake of claim 6 wherein said inner cylinder has opposed slots therein and the piston is connected to the hydraulic actuators by opposed link means which pass through said opposed slots.

8. A muzzle brake for an underwater gun comprising:

a projectile conveying means comprising concentric inner and outer cylinders having first and second ends, and said inner cylinder having at least one longitudinal slot therein;

means for sealing the projectile conveying means to the underwater gun at said first end;

means for sealing the projectile conveying means at its second end;

a piston having an aperture therethrough, positioned inside the inner cylinder and axially moveable therein adjacent the longitudinal slot in the inner cylinder;

actuator means positioned between the inner cylinder and the outer cylinder; and means extending through the longitudinal slot and joining the piston to the actuator means.

9. The muzzle brake of claim 8 wherein the actuator means comprises at least one hydraulic actuator.

10. The muzzle brake of claim 8 wherein the actuator means comprises at least one pneumatic actuator.

11. The muzzle brake of claim 8 wherein the actuator means comprises at least one solenoid.

12. The muzzle brake of claim 8 wherein the actuator means moves the piston to an initial position after the piston has been displaced to a second position in the inner cylinder.

13. The muzzle brake of claim 12 further comprising:

at least one additional piston having an aperture therein, said piston being movably positioned in the inner cylinder; and a second actuator means joined to move said additional piston to an additional piston first position from an additional piston second position in the inner cylinder.

* * * * *